US007722026B2

(12) United States Patent
Hirate et al.

(10) Patent No.: US 7,722,026 B2
(45) Date of Patent: May 25, 2010

(54) SHEET CONVEYER DEVICE AND IMAGE FORMING APPARATUS WITH ERROR JUDGING SYSTEM

(75) Inventors: Kensuke Hirate, Aichi (JP); Shunsuke Mizutani, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/420,376

(22) Filed: Apr. 8, 2009

(65) Prior Publication Data

US 2009/0250863 A1 Oct. 8, 2009

(30) Foreign Application Priority Data

Apr. 8, 2008 (JP) ..... 2008-100859

(51) Int. Cl.
*B65H 5/00* (2006.01)

(52) U.S. Cl. ..... 271/10.02; 271/258.03; 271/3.16

(58) Field of Classification Search ..... 271/258.03, 271/3.16, 4.02, 4.1, 265.01, 184, 902, 10.02, 271/245, 246
See application file for complete search history.

(56) References Cited

U.S. PATENT DOCUMENTS 5,488,463 A * 1/1996 Nimura et al. ..... 271/3.16
6,293,537 B1 * 9/2001 Park ..... 271/246
6,341,905 B1 1/2002 Suzuki
2003/0184002 A1 * 10/2003 Akiyama et al. ..... 271/110
2006/0039019 A1 * 2/2006 Okamoto ..... 358/1.12

FOREIGN PATENT DOCUMENTS

JP H09-058912 A 3/1997
JP 2000-351488 A 12/2000
JP 2001-080791 A 3/2001
JP 2001-233508 A 8/2001

* cited by examiner

*Primary Examiner*—Patrick H Mackey
*Assistant Examiner*—Gerald W McClain
(74) *Attorney, Agent, or Firm*—Baker Botts, LLP.

(57) ABSTRACT

A sheet conveyer device to convey a sheet in a conveyer path, including a first roller pair arranged in an intermediate position in the conveyer path, a feeder to feed the sheet toward the first roller pair during a feeding operation, a discharge portion, on which the sheet is discharged, a second roller pair arranged in the conveyer path in a position closer to the discharge portion than the first roller pair, a control unit to control the first and the second roller pairs to rotate synchronously, and a judging system to judge whether a sheet feeding error has occurred in the feeder, is provided. The control unit controls the first and the second roller pairs to rotate synchronously in a second direction during the feeding operation and in a first direction when the judging system judges that the sheet feeding error has occurred during the feeding operation.

6 Claims, 7 Drawing Sheets

SHEET CONVEYER DEVICE AND IMAGE FORMING APPARATUS WITH ERROR JUDGING SYSTEM

CROSS REFERENCE TO RELATED APPLICATION

This application claims priority from Japanese Patent Application No. 2008-100859 filed on Apr. 8, 2008, the entire subject matter of which is incorporated herein by reference.

BACKGROUND

1. Technical Field

Aspects of the present invention relate to a sheet conveyer device having a pair of discharge rollers, which nip a sheet therebetween and rotate to discharge the sheet out of a conveyer path, and an image forming apparatus having the sheet conveyer device.

2. Related Art

When an instruction for forming an image on a recording sheet is entered in an image forming apparatus (e.g., an inkjet printer), a feeder roller being pressed onto a surface of the recording sheet, which is stored in a sheet feed tray, rotates to direct the sheet into the sheet conveyer path. Along the sheet conveyer path in the image forming apparatus, several components for forming images are installed. Specifically, recording heads to record images on the recording sheet, a pair of conveyer rollers, and a pair of discharge rollers are provided. The conveyer rollers are arranged on an upstream side in the sheet conveyer path with respect to the recording heads, whilst the discharge rollers are arranged on a downstream side. The pair of conveyer rollers includes a driving roller, which is rotated by driving force provided by a drive source (e.g., a motor), and a subsidiary roller, which is pressed onto the driving motor and rotated according to the rotation of the driving roller. Similarly, the pair of discharge rollers includes a driving roller and a subsidiary roller. The driving rollers of the conveyer roller pair and the discharge roller pair are often connected to a single drive source and rotated in synchronization with each other. The recording sheet is carried in the sheet conveyer path by rotation of at least one of the conveyer roller pair and the discharge roller pair. The recording heads eject inks onto the surface of the recording sheet whilst the recording sheet is carried in the sheet conveyer path.

Japanese Patent Provisional Publication No. H09-58912 discloses a sheet discharging device for an image forming apparatus as above. The sheet discharging device specifically has a sheet sweeping rotary body, which is, according to the publication, a flexible and resilient piece (e.g., sponge) formed to have a shape of a gear. The sheet sweeping rotary body is attached onto a shaft of the driving roller of the discharge roller pair through an intervening one-way clutch. When the discharge rollers rotate in a direction to discharge the recording sheet into a discharge tray, the sheet sweeping rotary body rotates in the same discharging direction along with the driving roller of the discharge roller pair. When the sheet sweeping rotary body rotates, teeth in the gear can catch a rear end of the recording sheet so that the recording sheet is forwarded and swept out of the discharge rollers. When the discharge rollers rotate in a reverse direction which is opposite from the discharging direction, on the other hand, the sheet sweeping rotary body is not rotated due to an effect of the one-way clutch. Therefore, the recording sheet once discharged in the discharge tray is securely stopped by the discharge rollers from being reversely retracted once again between the discharge rollers, and reverse conveyance to convey the recording sheet in the reverse direction can be prevented.

Meanwhile, in the image forming apparatus, skew orientation of the recording sheet with respect to the conveyer path can be straightened by an operation so called a reverse registering operation. That is, when a feeder roller performs a feeding operation to pick up and feed the recording sheet into the sheet conveyer path, the conveyer rollers and the discharge rollers are rotated in the reverse directions so that the recording sheet conveyed to the conveyer roller pair is pushed back by the reverse rotation of the conveyer roller pair toward the upstream side of the sheet conveyer path. Thus, a front end of the recording sheet is halted at the conveyer roller pair and straightened with respect to the sheet conveyer path.

SUMMARY

Occasionally, the image forming apparatus may be obliged to have a small height difference between a top level of the discharge tray and a level of the discharge roller pair due to a volume limitation of the image forming apparatus, specifically when the entire image forming apparatus is configured to be small in height. Therefore, even when a small amount (e.g., several dozen) of discharged recording sheets are stacked in the discharge tray, a topmost sheet in the discharged sheet stack may be in a level barely lower than the level of the discharge roller pair. When a newly conveyed recording sheet is discharged on the stacked sheets, a front end of the recording sheet being newly discharged is subject to relatively large friction resistance caused by the topmost sheet in the sheet stack, and the recording sheet may halt, immediately upon completion of the discharging operation, with a rear end thereof approximated to the discharge rollers. When a next feeding operation starts, in synchronization with the reverse registering, with the rear end of the previously discharged recording sheet approximated to the discharge rollers, the previously discharged recording sheet may be retracted between the discharge rollers and reversely carried in the conveyer path. When the rear end of the previously discharged recording sheet is thus close to the discharge roller pair, preventing the reverse conveyance of the once discharged recording sheet is yet difficult, even with the sheet sweeping rotary body provided to the driving roller of the discharge roller pair. Specifically, it is to be noted that the reverse conveyance is likely to occur upon a sheet feeding error, for example, in which the feeder roller slips on the topmost recording sheet stacked in the sheet feed tray, and in which the recording sheet is jammed in the sheet conveyer path. When the feeding operation resumes after an error cause is removed, the recording sheet left in the sheet conveyer path may be reversed toward the upstream side further from the conveyer rollers and interfere a next feeding operation. Therefore, removal of the recording sheet remaining in the sheet conveyer path is required prior to the next feeding operation so that the remaining recording sheet should not interfere a succeeding recording sheet fed in the next feeding operation.

Additionally, when the reverse conveyance occurs in a scanner device having an ADF (auto document feeder), and a once discharged original document is withdrawn in a sheet conveyer path according to reverse registering of the original documents, a next original document to be scanned may be interfered with the reversed document in the sheet conveyer path, and an image on the next original document may not be scanned correctly.

In view of the above drawbacks, the present invention is advantageous in that a sheet conveyer device capable of preventing a reversely conveyed sheet from interfering a next feeding operation, which is resumed after a sheet feeding error, and an image forming apparatus having the sheet conveyer device are provided.

According to an aspect of the present invention, a sheet conveyer device to convey a sheet in a conveyer path is provided. The sheet conveyer device includes a first roller pair, which is arranged in an intermediate position in the conveyer path and conveys the sheet in the conveyer path, a feeder to feed the sheet in the conveyer path toward the first roller pair during a feeding operation, a discharge portion, on which the sheet carried through the conveyer path is discharged, a second roller pair, which is arranged in the conveyer path in a position closer to the discharge portion than the first roller pair and conveys the sheet in the conveyer path, a control unit to control the first roller pair and the second roller pair to rotate synchronously in one of a first direction, being a direction to convey the sheet toward the discharge portion, and a second direction, being a direction opposite from the first direction, and a judging system to judge as to whether a sheet feeding error has occurred in the feeder. The control unit controls the first roller pair and the second roller pair to rotate synchronously in the second direction during the feeding operation and to rotate synchronously in the first direction when the judging system judges that the sheet feeding error has occurred during the feeding operation.

According to the above configuration, when the judging system judges that a feeding error has occurred in the feeder during the feeding operation, the first roller pair and the second roller pair having been rotated synchronously in the second direction are switched to rotate in the first direction. Therefore, when the sheet having been conveyed in the second direction is present in the conveyer path, the sheet is discharged out of the conveyer path by the second roller pair. Accordingly, the feeding operation resumed after the feeding error can be performed without being interrupted by the sheet which was left in the conveyer path.

According to another aspect of the present invention, an image forming apparatus is provided. The image forming apparatus includes a sheet conveyer device to convey a sheet in a conveyer path and an image forming unit to form an image on the sheet conveyed in the conveyer path. The sheet conveyer device includes a first roller pair, which is arranged in an intermediate position in the conveyer path and conveys the sheet in the conveyer path, a feeder to feed the sheet in the conveyer path toward the first roller pair during a feeding operation, a discharge portion, on which the sheet carried through the conveyer path is discharged, a second roller pair, which is arranged in the conveyer path in a position closer to the discharge portion than the first roller pair and conveys the sheet in the conveyer path, a control unit to control the first roller pair and the second roller pair to rotate synchronously in one of a first direction, being a direction to convey the sheet toward the discharge portion, and a second direction, being a direction opposite from the first direction, and a judging system to judge as to whether a sheet feeding error has occurred in the feeder. The control unit controls the first roller pair and the second roller pair to rotate synchronously in the second direction during the feeding operation and to rotate synchronously in the first direction when the judging system judges that the sheet feeding error has occurred during the feeding operation. The image forming unit is arranged along the conveyer path between the first roller pair and the second roller pair.

According to the above configuration, the feeding operation resumed after the feeding error can be performed without being interrupted by the sheet which was left in the conveyer path. Therefore, an image can be effectively formed on the sheet which is fed in the resumed feeding operation.

BRIEF DESCRIPTION OF THE ACCOMPANYING DRAWINGS

DETAILED DESCRIPTION

Figure 1:
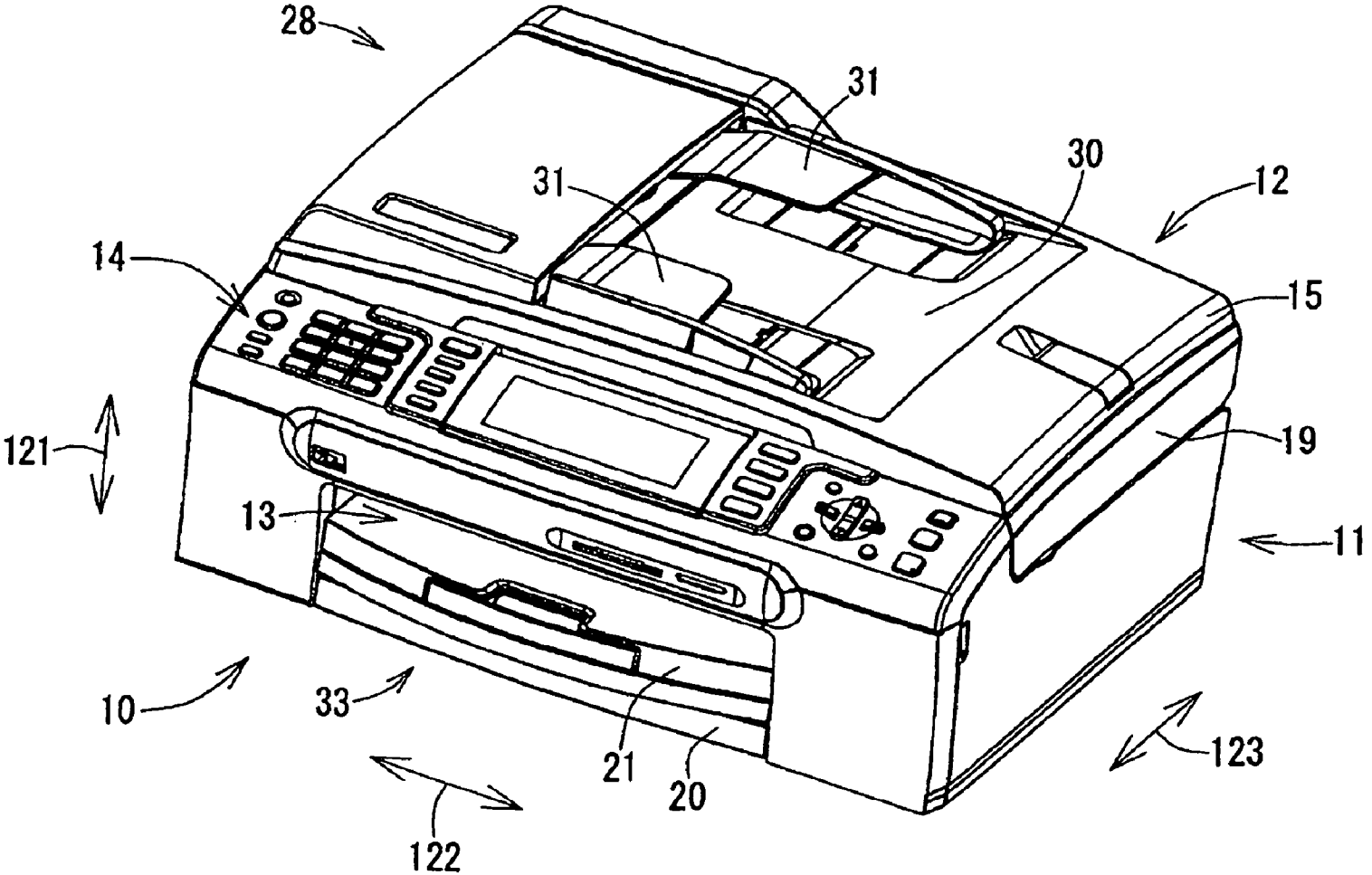
FIG. 1 illustrates an external and perspective view of an MFD (multi-function device) 10 according to an embodiment of the present invention.
Figure 2:
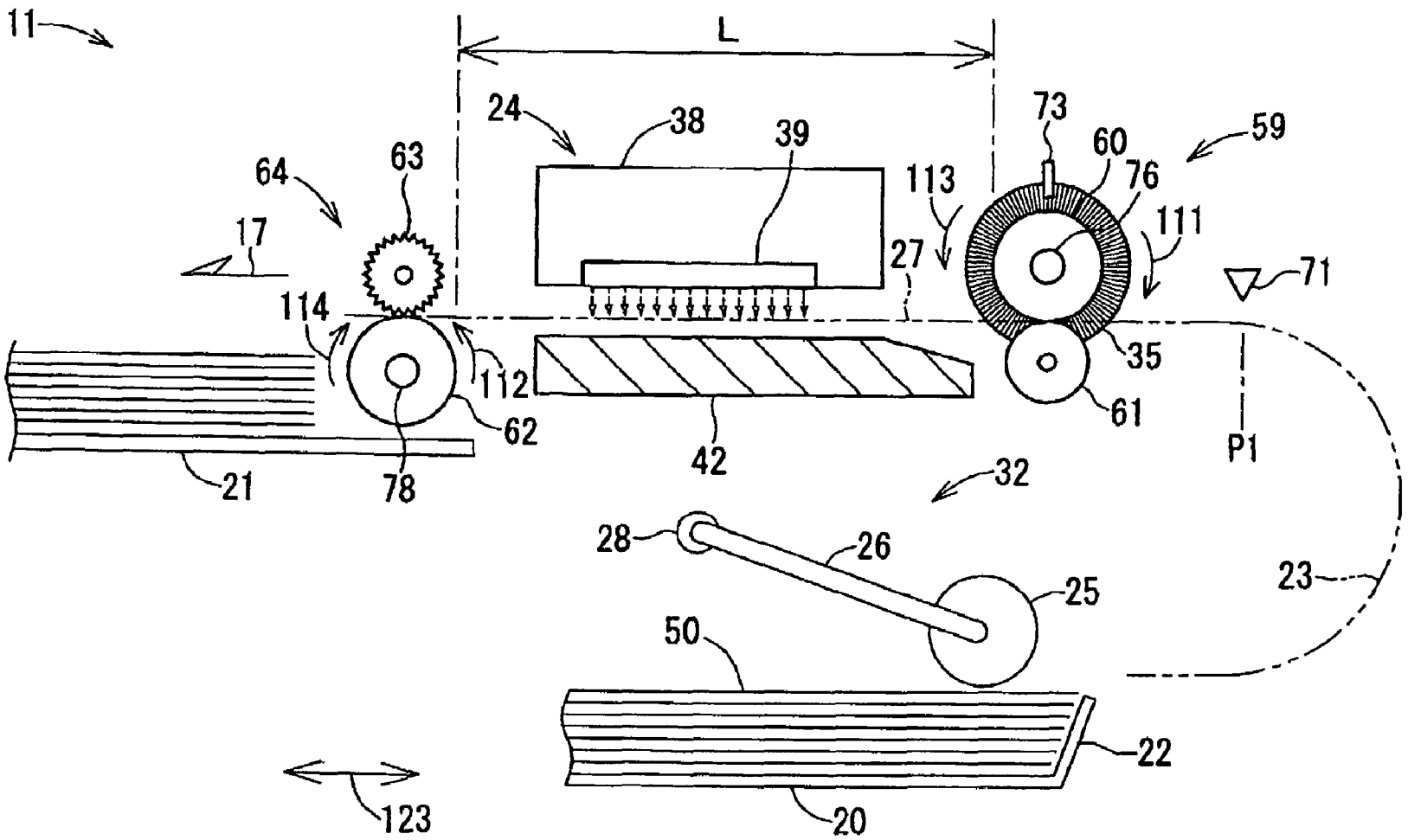
FIG. 2 illustrates an internal configuration of a printer unit 11 of the MFD according to the embodiment of the present invention.

Hereinafter, embodiments according to the present invention will be described with reference to the accompanying drawings. FIG. 1 illustrates an external and perspective view of the MFD 10 according to the embodiment of the present invention. FIG. 2 illustrates an internal configuration of a printer unit 11 of the MFD 10 according to the embodiment of the present invention, although a part of a feed tray 20 and a part of a discharge tray 21 are omitted and not shown. First, an overall configuration of an MFD 10 according to the embodiment of the present invention will be described.

The MFD 10 according to the present embodiment is configured integrally with a printer unit 11 and a scanner unit 12 and provided with functionalities for printing, scanning, and facsimile transmission. However, the MFD 10 may not necessarily be equipped with the scanner unit 12, but the MFD 10 may be replaced with a printer device having solely a printing function.

A body of the MFD 10 according to the present invention has an approximate shape of a box with a width and a depth being respectively greater than a height. In FIG. 1, directions of height, width, and depth of the MFD 10 are as indicated by arrows 121, 122, and 123 respectively.

The printer unit 11 is provided in a bottom portion of the MFD 10. The printer unit 11 is configured to form an image on a recording sheet 50 according to print data, which can be entered through the scanner unit 12 and from an external environment (not shown).

The scanner unit 12 being a flatbed scanner is provided at an upper portion of the MFD 10, and a topmost portion includes a document cover 15, which is openable/closable with respect to an original document holder 19 of the MFD 10. The scanner unit 12 includes a contact glass (not shown) and an image sensor (not shown) at a topmost surface of the original document holder 19. The contact class is a flat and transparent glass plate on which an original document to be scanned is placed. The image sensor is a line sensor, which extends in the direction of depth 123 and is installed underneath the contact glass. The image sensor is capable of being reciprocated in the direction of width 122 so that, when an original document with an image formed thereon is set on the contact glass and a scanning operation is started, the image is read by the image sensor.

The document cover 15 makes a top level of the MFD 10 and includes an ADF 29. The ADF 29 transports original documents stacked in the original document tray 30 to a document discharge tray 31 through a conveyer path (not shown). Whilst being transported by the ADF 29, each of the original documents passes over the contact glass so that the image sensor can read an image formed on the original document through the contact glass. The original documents passed over the contact glass are held by the document discharge tray 31 at opposing sides thereof so that the discharged original documents can be held separately from the unread original documents on the original document tray 30.

The MFD 10 is provided with an operation panel 14 in an upper front portion thereof. (In the present embodiment, a near left side in FIG. 1 corresponds to the front of the MFD 10.) The operation panel 14 includes a display, which presents various information concerning operations, and keys, through which a user enters information and instructions. The MFD 10 operates according to the information and instructions entered through the operation panel 14 and transmitted from external devices.

Next, the printer unit 11 will be described. The printer unit 11 includes a sheet cassette 33, which is configured to be inserted into the printer unit 11 through an opening 13. The sheet cassette 33 includes a detachable feed tray 20 and a discharge tray 21, and the discharge tray 21 is disposed above the feed tray 20 in the sheet cassette 33. The feed tray 20 is a substantially box-shaped container to store a stack of recording sheets 50 (see FIG. 2) therein. The feed tray 20 accepts various sizes of the recording sheets 50, e.g., letter, legal, and postcard, to store therein. Meanwhile, the discharge tray 21 is a substantially flat plate having a depthwise length in the direction of depth 123 smaller than a depthwise length of the feed tray 20. The sheet cassette 20 with the feed tray 20 and the discharge tray 21 is arranged on the front side (i.e., a left-hand side in FIG. 2) of the MFD 10, and the feed tray 20 is partially open-ended at a side closer to the rear (i.e., a right-hand side in FIG. 2) of the MFD 10. The recording sheets 50 stored in the feed tray 20 are fed and carried in the paths 23, 27 to the printer unit 11, in which images are formed thereon, and discharged out of the path 27. The discharged recording sheets 50 are settled and piled up on the discharge tray 21. Various materials of the recording sheets 50 may be accepted in the sheet cassette 33, for example, standard paper, gloss paper, and inkjet-printer paper.

The printer unit 11 according to the present embodiment includes a feeder unit 32, a conveyer path including paths 23, 27, a conveyer roller pair 59, a discharge roller pair 64, an image forming unit 24, in addition to the feed tray 20 and the discharge tray 21.

The paths 23, 27 are courses in which the recording sheets 50 fed by the feed tray 20 are conveyed. The path 23 starts in the vicinity of a slope board 22 and includes a curve arched upward to orient the front of the MFD 10. The path 27 is continuous from the path 23 and extends linearly along the image forming unit 24 toward the discharge tray 21.

The slope 22 is arranged at a rear end (i.e., right-hand end) of the feed tray 20 in an inclined orientation to lean toward the rear of the MFD 10. When the feed tray 20 is installed in the printer unit 11, the slope board 22 comes in a position below a point where the path 23 starts. The recording sheets 50 stored in the feed tray 20 are fed along the slope bode 22 into the path 23.

The feeder unit 32 is provided substantially above the feed tray 22. The feeder unit 32 feeds the recording sheets 50 in the feed tray 20 into the path 23, through the conveyer roller pair 59, and into the feed tray 27. The feeder unit 32 includes a feed roller 25, an arm 26, and a shaft 28. The feed roller 25 is configured to come in contact with a topmost surface of the recording sheets 50 stored in the feed tray 20 and picks up at least the topmost recording sheet 50 to feed. The arm 26 is supported by a frame (not shown) of the printer unit 11 and rotatable about the shaft 28. The arm 26 is pivoted to orient in a direction to droop downward by weights of the arm 26 itself and the feed roller 25 and/or expanding force of a resilient member (not shown) such as a spring. Thus, the feed roller 25 is pressed onto the topmost recording sheet 50 in the feed tray 20 with effectual pressure. With the feed roller 25 pressed onto the recording sheet 50, driving force generated in a motor 84 (see FIG. 4) is transmitted to the feed roller 25 through the shaft 28 and a transmitting system (not shown) in the arm 26 so that the feed roller 25 rotates. The recording sheet 50 in contact with the feed roller 25 is therefore picked up according to rotation of the feed roller 25 and fed along the inclination of the slope board 22 into the path 23. The slope board 22 has a separator piece (not shown), which separates the topmost recording sheet from succeeding recording sheets 50.

In the printer unit 11, a platen 42 to hold the recording sheet 50 substantially flat in the path 27 is provided in a position below the path 27 to oppose a lower surface of the image forming unit 24. Thus, the recording sheet is maintained substantially flat on the platen 24 to have the image recorded thereon by the image forming unit 24 with a predetermined clearance from the lower surface of the image forming unit 24.

The pair of conveyer rollers 59 is provided in an intermediate position in the path 27 on the upstream side with respect to a conveying direction 17 than the image forming unit 24. The conveyer roller pair 59 includes a conveyer roller 60 and a pinch roller 61, which convey the recording sheet 50 in the path 27. In the present embodiment, the conveyer roller 60 is arranged on an upper side of the path 27, whilst the pinch roller 61 is arranged below the path 27 to oppose the conveyer roller 60. The conveyer roller 60 is rotated by driving force of a motor 85 (see FIG. 4) through a drive force transmission system 90 (see FIG. 3). The pinch roller 61 is biased toward and pressed onto the conveyer roller 60, therefore rotatable along with the rotation of the conveyer roller 60. When the recording sheet 50 is forwarded in the path 27 between the conveyer roller 60 and the pinch roller 61, the pinch roller 61 is shifted away from the conveyer roller 60 for a thickness amount of the recording sheet 50. Still the pinch roller 61 is biased toward the conveyer roller 60 so that the rotation of the conveyer roller 60 is transmitted to the recording sheet 50. The recording sheet 50 is thus nipped with the conveyer roller 60 and the pinch roller 61 and carried to the position above the platen 42.

The pair of discharge rollers 64 is arranged in the path 27 on the downstream side with respect to the conveying direction 17 than the image forming unit 24 in the vicinity of the discharge tray 21. That is, the discharge roller pair 64 is arranged in the path 27 in a position closer to the discharge tray 21 than the conveyer roller pair 59. The discharge roller pair 64 includes a discharge roller 62 and a spur 63, which carry the recording sheet 50 in the path 27. In the present embodiment, the discharge roller 62 is arranged on the lower side of the path 27, whilst the spur 63 is arranged on the upper side of the path 27 to oppose the discharge roller 62. The discharge roller pair 64 is separated from the conveyer roller pair 59 to have a length L therebetween in the conveying direction 17 so that the image forming unit 24 can be arranged within the length L. Further, according to the present embodiment, the discharge roller 62 is formed to have a circumference equivalent to a circumference of the conveyer roller 60. The discharge roller 62 is rotated by driving force of the motor 85 through the drive force transmission system 90. The spur 63 is biased toward and pressed onto the discharge roller 62, therefore rotatable along with the rotation of the discharge roller 62. When the recording sheet 50 is forwarded in the path 27 between the discharge roller 62 and the spur 63, the spur 63 is shifted away from the discharge roller 62 for the thickness amount of the recording sheet 50. Still the discharge roller 62 is biased toward the discharge roller 62 so that the rotation of the discharge roller 62 is transmitted to the recording sheet 50. The recording sheet 50 is thus nipped with the discharge roller 62 and the spur 63 and forwarded to the discharge tray 21.

Figure 3:
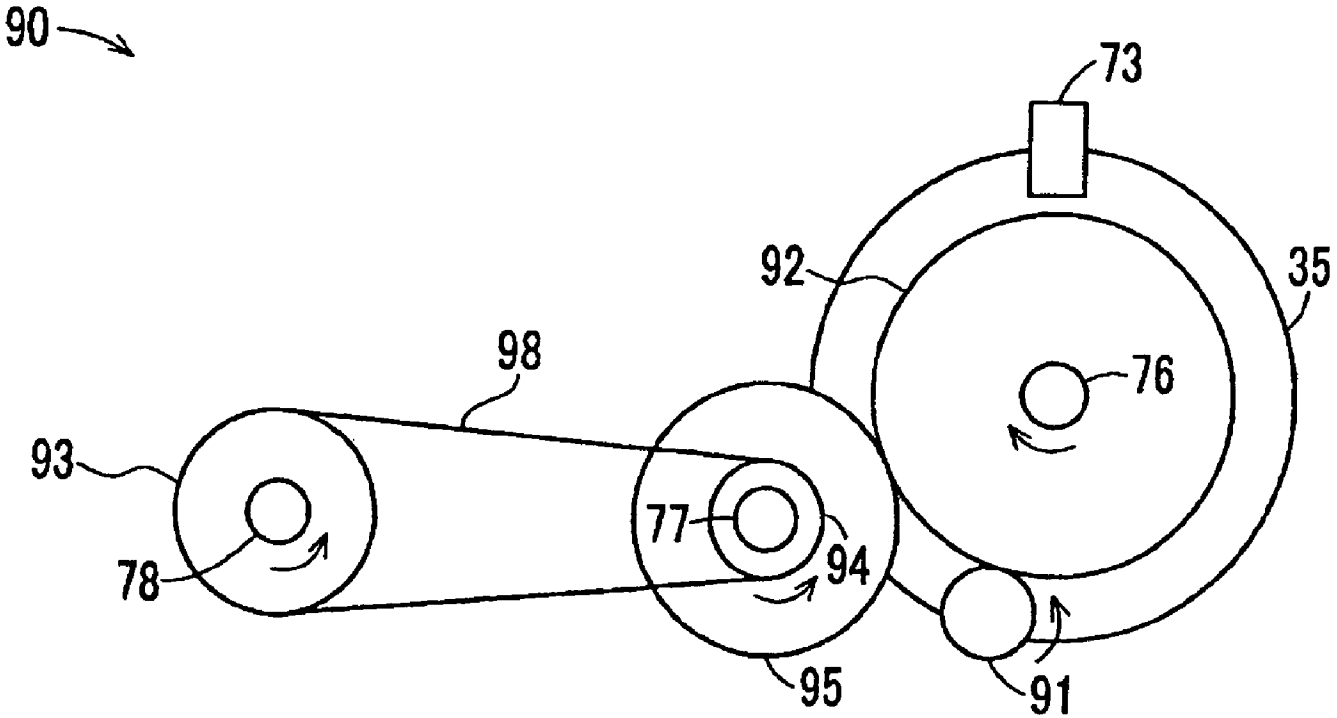
FIG. 3 illustrates a drive force transmission system 90 in the MFD 10 according to the embodiment of the present invention.

The drive force transmission system 90 transmits the driving force generated in the motor 85 to the conveyer roller 60 and the discharge roller 62. FIG. 3 illustrates a drive force transmission system 90 in the MFD 10 according to the embodiment of the present invention. The drive force transmission system 90 includes a motor gear 91, a gear 92, a connection gear 95, a pulley 94, a belt 98, and a pulley 93. In FIG. 3, the conveyer roller 60 and the discharge roller 62 are omitted. Further, the motor gear 91, the gear 92, the connection gear 95, the pulley 94, the belt 98, and the pulley 93 are represented in circles, and teeth formed on those are omitted.

In the drive force transmission system 90, the motor gear 91 is coupled to the motor 85. The gear 92 is fixed to a shaft 76 (see FIG. 2) of the conveyer roller 60 and rotates about the shaft 76 along with the conveyer roller 60. The gear 92 is engaged with the motor gear 91. The gear 92 is also engaged with the connection gear 95, which is arranged in the vicinity of the gear 92 and rotatable about a shaft 77. The pulley 93 is fixed to a shaft 78 (see FIG. 2) of the discharge roller 62 and rotatable about the shaft 78 along with the discharge roller 62. The belt 98, which is an endless belt with teeth formed inside, is extended between the pulley 93 and the pulley 94. The pulley 94 is fixed to the shaft 77 of the connection gear 95.

When the driving force generated in the motor 85 is transmitted to the gear 92 through the motor gear 91. Accordingly, the conveyer roller 60 is rotated. Further, the driving force transmitted to the gear 92 is conveyed to the pulley 93 through the connection gear 95, the pulley 94, and the belt 98. Accordingly, the discharge roller 62 is rotated. Thus, the conveyer roller 60 and the discharge roller 62 are rotated synchronously by a same drive source, i.e., the motor 85. Moreover, the discharge roller 62 and the spur 63 are rotated in synchronization with the conveyer roller 60 and the pinch roller 61. The recording sheet 50 forwarded in the path 27 is therefore conveyed to the position above the platen 43 by the conveyer roller 60 and the pinch roller 61. Thereafter, the recording sheet 50 is forwarded to the discharge roller pair 64 between the discharge roller 62 and the spur 63 and further forwarded to the position above the discharge tray 21. When the discharge roller pair 64 releases the rear end of the recording sheet 50, the recording sheet 50 is discharged in the discharge tray 21.

A height difference between the upper level of the discharge tray 21 and the nipped position of the discharge roller 62 with the spur 63 is determined based on an allowable number of recording sheets to be stacked in the discharge tray 21. In the present embodiment, a height to allow the discharge tray 21 to hold several tens of recording sheets is set between the upper level of the discharge tray 21 and the nipped position of the discharge roller 62 with the spur 63.

In FIG. 3, directions of rotation of the motor gear 91 and the shafts 76, 77, 78 to convey the recording sheet 50 in the conveying direction 17 are indicated by arrows. As shown in FIG. 3, when the driving force of the motor 85 is transmitted to the shaft 76, 78 through the drive force transmission system 90, the shaft 76 of the conveyer roller 60 and the shaft 78 of the discharge roller 62 rotate in the directions opposite from each other. However, in the present embodiment, the discharge roller 62 is arranged on the side opposite from the conveyer roller 60 with respect to the path 27; therefore, the direction of the conveyer roller pair 59 to forward the recording sheet 50 coincides with the direction of the discharge roller pair 64 to forward the recording sheet 50. In the present embodiment, when polarity of the electricity to be supplied to the motor 85 is inversed, the motor gear 91 and the shafts 76, 77, 78 rotate in directions opposite from the directions indicated by the respective arrows in FIG. 3.

Next, the image forming unit 24 will be described. As shown in FIG. 2, the image forming unit 24 is disposed in along the path 27 between the conveyer roller pair 59 and the discharge roller pair 64. The image forming unit 24 includes recording heads 39 being inkjet heads and a carriage 38 on which the recording heads 39 are mounted. The carriage 38 is driven to reciprocate in the widthwise direction 122 of the MFD 10 during a printing operation. The recording heads 39 are provided with nozzles, which are directed downward and exposed through a bottom level of the carriage 38. The recording heads 39 are supplied with inks by ink cartridges (not shown), which are arranged inside the printer unit 11. The inks in ink drops are ejected from the nozzles of the recording heads 39 downward onto the recording sheets 50 held by the platen 42 whilst the carriage 38 is reciprocated. Thus, an image is formed on the upper surface of the recording sheet 50.

Next, mechanism to detect presence of the recording sheet 50 in the paths 23, 27 will be described. As shown in FIG. 2, the shaft 76 of the conveyer roller 60 is provided with a disk-shaped encoder disk 35. Further, an optical sensor 73, which is arranged to have a circumferential edge of the encoder disk 35 in-between, is provided. The encoder disk 35 is a transparent disk to rotate coaxially along with the conveyer roller 60 and have radiated marks which are arranged in a predetermined pitch. The optical sensor 73 is arranged in the vicinity of the conveyer roller 60. The optical sensor 73 has a light-emitting element (not shown) and a light-receiving element (not shown) and is arranged to have the light-emitting element and the light-receiving element on either side of the circumferential edge of the encoder disk 35. When the light emitted from the light-emitting element is received by the light-receiving element, a sensor signal depending on a level of brightness being received is generated. When one of the marks is present in between the light-emitting element and the light-receiving element, a high-leveled sensor signal is generated. On the other hand, when no mark is present in between, a low-leveled sensor signal is generated. The sensor signal generated in the optical sensor 73 is transmitted to a control unit 100 (see FIG. 4).

In the printer unit 11, a register sensor 71 is provided in a position P1 in the conveyer path including the paths 23, 27. The position P1 is a position opposite from the discharge roller pair 64 with respect to the conveyer roller pair 59. In other words, the position P1 is on the upstream side of the paths 23, 27, closer to the feed tray 20 in the conveying direction 17 than the conveyer roller pair 59. The register sensor 71 is to detect presence of the recording sheet 50 in the conveyer path. In the present embodiment, the register sensor 71 is a so-called mechanical sensor, which includes a photo-interrupter and a rotatably-supported feeler. The photo-interrupter has a light emitter to emit light toward a light receiver and the light receiver to receive the emitted light. When the recording sheet 50 carried in the path 23 reaches the position P1, the recording sheet 50 becomes in contact with the feeler, and the feeler is rotated. Thus, the levels of the sensor signals generated in the register sensor 71 are varied. The generated sensor signals are transmitted to the control unit 100, which detects presence of the recording sheet 50 in the position P1.

Figure 4:
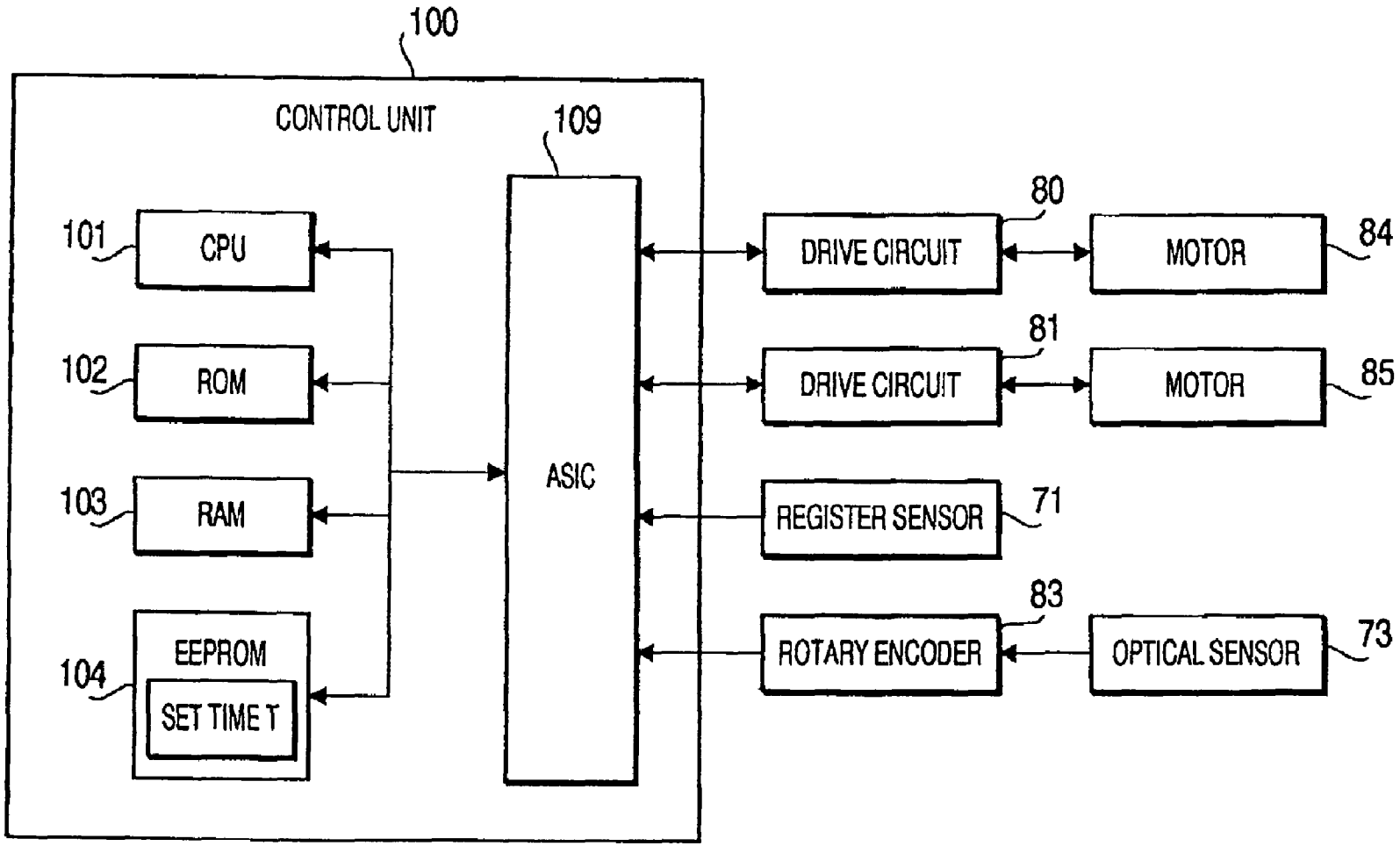
FIG. 4 is a block diagram to illustrate a control unit 100 in the MFD 10 according to the embodiment of the present invention.

Next, the control unit 100 to control overall behaviors of the MFD 10 will be described. FIG. 4 is a block diagram to illustrate the control unit 100 in the MFD 10 according to the embodiment of the present invention. The control unit 100 is a microcomputer which includes a CPU 101, a ROM 102, a RAM 103, an EEPROM 104, and an ASIC (Application Specific Integrated Circuit) 109. The control unit 100 controls behaviors of the motors 84, 85, and the printer unit 11, and the scanner unit 12.

The ROM 102 stores therein various programs to be run to control the behaviors of the motors 84, 85, and the entire MFD 10. The RAM 103 is a storage area being a memory area, in which various data to be used in the running programs is stored, and a work area for various data processing. In the beginning of a printing operation in the printer unit 11, the control unit 100 starts counting for an elapsed time period t when the recording sheet 50 starts being fed from the feed tray 20 into the path 23. In this regard, the elapsed time t is temporarily stored in the RAM 103. Meanwhile, the EEPROM 104 stores data such as settings and flags concerning the MFD 10 which is to be maintained even after the control unit 100 is powered off. A predetermined set time T is stored in the EEPROM 104. Behaviors of the MFD 10 based on the elapsed time t and the set time T will be described later in detail.

The ASIC 109 is connected with drive circuits 80, 81, the register sensor 71, and a rotary encoder 83. Further, although not shown in FIG. 4, the ASIC 109 is connected with a head control circuit to control the recording heads 39, the operation panel 14, and the scanner unit 12. Description of these devices controlled by the ASIC 109 is herein omitted.

The register sensor 71 generates sensor signals based on presence/absence and a position of the recording sheet 50 in the paths 23, 27 so that the control unit 100 judges presence or absence of the recording sheet 50 in the paths 23, 27, as to whether the front end of the recording sheet 50 reached the position P1, and as to whether the rear end of the recording sheet 50 has passed the position P1.

The rotary encoder 83 counts the marks provided on the encoder disk 35 (see FIG. 2) according to the detected result obtained by the optical sensor 73 (see FIGS. 2 and 4) so that a rotation amount of the encoder disk 35 is obtained. Each time when the optical sensor 73 detects the mark on the encoder disk 35, a high-leveled sensor signal is generated. In the present embodiment, the encoder disk 35 rotates coaxially along with the conveyer roller 60; therefore, a rotation amount of the conveyer roller 60 can be obtained based on the rotation amount of the encoder disk 35. The obtained rotation amount of the conveyer roller 60 is passed to the control unit 100. Thus, the control unit 100 obtains a rotation speed of the conveyer roller 60, and the discharge roller 62 as well, based on the rotation amount within a unit of time achieved from the rotary encoder 83.

The drive circuit 80 drives the motor 84, which is coupled to the feed roller 25 through the shaft 28 and the arm 26. The drive circuit 80 drives the motor 84 according to signals output from the ASIC 109. Thus, the recording sheets 50 in the feed tray 20 are fed into the path 23 in a feeding operation.

The drive circuit 81 drives the motor 85, which is coupled to the shaft 76 of the conveyer roller 60 and the shaft 78 of the discharge roller 62 through the drive force transmission system 90. The drive circuit 81 drives the motor 85 according to signals output from the ASIC 109. The drive force generated in the motor 85 is thus transmitted to the shafts 76, 78 respectively through the drive force transmission system 90. Therefore, the conveyer roller 60 and the discharge roller 62 are rotated in synchronization with each other.

According to the present embodiment, the conveyer roller 60 and the discharge roller are capable of rotating in first and normal directions 111, 112 (see FIG. 2) and in second and reverse directions 113, 114 respectively under control of the control unit 100. When the recording sheet 50 is picked up from the sheet tray 20 into the path 23 in the feeding operation, the conveyer roller pair 59 and the discharge roller pair 64 are at the same time rotated in reverse directions in a reverse rotating operation so that the recording sheet 50 reached the conveyer roller pair 59 is pushed back in an opposite direction from the conveying direction 17, and the orientation of the recording sheet 50 is straightened with respect to the conveyer path. Therefore, in the reverse registering operation, the control unit 100 controls the drive circuit 81 to drive the motor 85 so that the conveyer roller 60 and the discharge roller 62 are rotated in the second and reverse directions 113, 114 respectively and synchronously. Thus, the front end of the recording sheet 50 carried in the paths 23, 27 is pushed back by the conveyer roller pair 59 and stops.

When the reverse registering operation is completed, the control unit 100 controls the conveyer roller 60 and the discharge roller 62 in the normal directions 111, 112, which are opposite from the second directions 113, 114 respectively. Thus, the recording sheet 50, which is nipped with the conveyer roller pair 59 and the discharge roller pair 64, is carried in the conveying direction 17.

Figure 5:
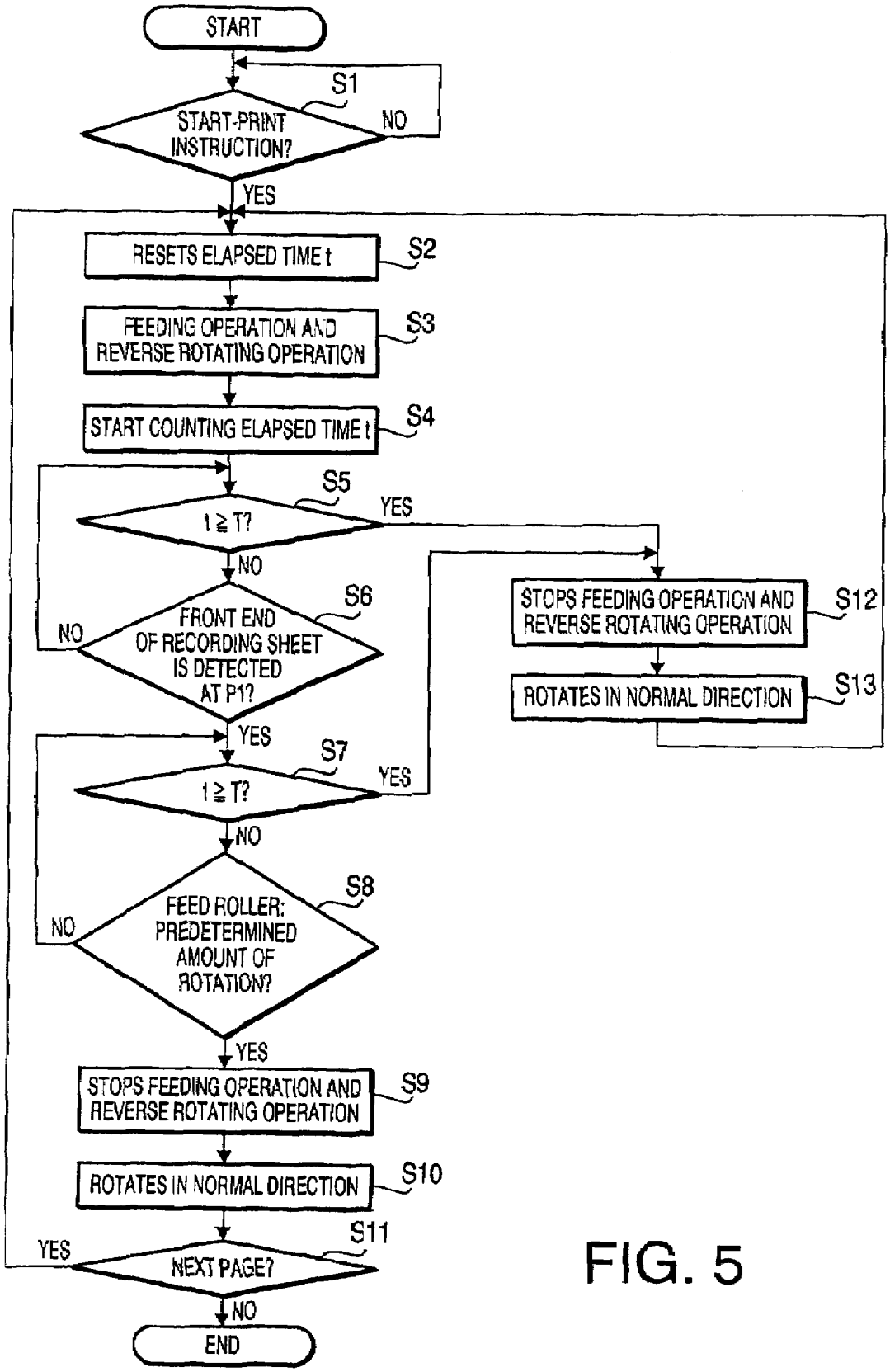
FIG. 5 is a flowchart to illustrate a feeding operation to feed a recording sheet in the printer unit 11 in the MFD 10 according to the embodiment of the present invention.

Next, a feeding operation to pick up and feed the recording sheet 50 into the path 23 will be described with reference to FIG. 5. FIG. 5 is a flowchart to illustrate the feeding operation to feed and convey the recording sheet 50 in the printer unit 11 in the MFD 10 according to the embodiment of the present invention. Each step in the flowchart shown in FIG. 5 is conducted based on instructions issued by the control unit 100 according to a program stored in the ROM 102.

When the feeding operation starts, in S1, the control unit 100 examines to judge as to whether an instruction to start printing is entered. Additionally, the control unit 100 examines to judge as to whether an instruction command to start printing along with printable data is transmitted from an external device and received. When no instruction to start printing is received (S1: NO), the control unit 100 sets the MFD 10 in a standby state. When an instruction to start printing is received (S1: YES), in S2, the control unit 100 resets the elapsed time t; i.e., the control unit 100 deletes a value representing the elapsed time t and stored in the RAM.

In S3, the control unit starts the feeding operation and the reverse rotating operation. More specifically, the control unit 100 rotates the feed roller 25 to feed the recording sheet 50 in the path 23 and at the same time rotates the conveyer roller 60 and the discharge roller 62 in the second directions 113, 114 respectively. In S4, the control unit 100 times an elapsed time period t since S3, i.e., the beginning of the feeding operation by the feed roller 25. In the present embodiment, occurrence of a feeding error of the recording sheet 50 is judged based on the elapsed time t. The feeding error refers to failure of the feed roller 25 to feed the recording sheet 50 in the path 23 to the conveyer roller pair 59 and may include, for example, slipping and idle rotation of the feed roller 25 on the topmost recording sheet 50 and sheet jam in the path 23. The control unit 100 examines to judge as to whether the feeding error has occurred based on the elapsed time t; i.e., it is determined that a feeding error has occurred when the elapsed time t is greater than a set time T and the register sensor 71 fails to detect the recording sheet 50 during the elapsed time t.

Following S4, in S5, the control unit 100 examines to judge as to whether the elapsed time t is greater than or equal to the set time T. More specifically, the control unit 100 reads the set time T stored in the EEPROM 104 and compares to the elapsed time t. In the present embodiment, the set time T is longer than a period A, which starts upon beginning of the feeding operation and ends when the recording sheet 50 is assumed to be detected by the register sensor 71 without being interrupted by a feeding error. The period A may be determined, for example, based on a distance between the slope board 22 and the position P1 in the path 23 and a rotation speed of the feed roller 25 during the feeding operation.

In the present embodiment, as has been described above, when several dozen of recording sheets 50 are piled up on the discharge tray 21, the height difference between the level of the topmost recording sheet 50 on the discharge tray 21 and the nipped position of the discharge roller pair 64 becomes small. When an additional recording sheet 50 is carried in the path 27 and discharged on the discharge tray 21, the front end of the recording sheet 50 being discharged is subject to relatively large friction resistance caused by the topmost recording sheet 50 in the discharged sheet stack. Specifically, when the recording sheets 50 are gloss papers, the friction resistance becomes notably larger than a regular sheet of paper. Therefore, the rear end of the newly discharged recording sheet is approximated to the discharge roller 62 upon completion of the discharging operation. When the reverse registering operation is conducted, i.e., the conveyer roller 60 and the discharge roller 62 are rotated in the second directions 113, 114, with the rear end of the newly discharged recording sheet close to the discharge roller 62, the newly discharged recording sheet 50 may be caught in between the discharge roller pair 64 to be withdrawn in the path 27.

In this regard, when the set time T is longer than necessary, and when the newly-discharged recording sheet 50 on the discharge tray 21 is withdrawn in the path 27 immediately after start of rotation of the conveyer roller 60 in the second direction 113 and the discharge roller 62 in the second direction 114, the reversely carried recording sheet 50 may reach the conveyer roller pair 59 before the elapsed time t reaches the set time T. When the withdrawn recording sheet 50 is carried reversely further on the upstream side with respect to the conveyer roller 59 to reach the position P1, the register sensor 71 will detect the reversely carried recording sheet 50. In other words, the resister sensor 71, which is to detect the recording sheet 50 to be carried in the direction 17 from the feed tray 21 toward the conveyer roller pair 59, can undesirably detect the reversely carried recording sheet 50. In this occasion, the control unit 100 may not be able to correctly judge occurrence of a feeding error during the feeding operation with the feed roller 25. In consideration of the above, the set time T is required to be longer than the period A, and shorter than a period B, which starts upon rotation of the conveyer roller 60 and the discharge roller 62 to reversely convey the recording sheet 50 on the discharge tray 21 and ends when the reversely conveyed recording sheet 50 is assumed to reach the conveyer roller pair 59. The period B may be determined, for example, based on the length L (see FIG. 2) between the conveyer roller 60 and the discharge roller 62 and a rotation speed of the conveyer roller 62 (and the discharge roller 62), which can be obtained based on the result detected by the rotary encoder 83.

In S5, when the control unit 100 determines that the elapsed time t is smaller than the set time T (S5: NO), in S6, the control unit 100 judges as to whether the front end of the recording sheet 50 is detected at the position P1 based on the level of the sensor signal, which is output from the register sensor 71. When the front end is not detected at the position P1 (S6: NO), the control unit 100 returns to S5. In the present embodiment, as has been described above, the set time T is longer than the period A; therefore, when the elapsed time t is greater than or equal to the set time T and when no recording sheet 50 is detected by the register sensor 71 since the feeding operation with the feed roller 25 started (S5: YES), the control unit 100 determines that a feeding error has occurred and proceeds to S12.

When the front end is detected (S6: YES), the control unit 100 judges that no feeding error has occurred in the feeding operation with the feed roller 25 and proceeds to S7. In S7, the control unit 100 judges as to whether the elapsed time t is greater than or equal to the set time T. When the elapsed time t is greater than or equal to the set time T (S7: YES), the control unit 100 determines that a feeding error has occurred and proceeds to S12.

When the elapsed time t is smaller than the set time T (S7: NO), in S8, the control unit 100 judges as to whether the feed roller 25 has been driven to rotate for a predetermined amount (or a predetermined rotation angle), by which the recording sheet 50 could be carried beyond the conveyer roller pair 59, after the affirmative judgment in S6 (S6: YES); i.e., detection of the recording sheet 50 at the position P1 by the register sensor 71. Within the predetermined amount of rotation (or the predetermined rotation angle), according to the present embodiment, it is assumed that the recording sheet 50 could be transported beyond the conveyer roller pair 59 in the path 27; however, the front end of the recording sheet 50 comes in contact with the conveyer roller pair 59, which is rotated in the reverse rotating operation activated in S3. Therefore, the recording sheet 50 cannot be carried beyond the conveyer roller pair 59 but pushed backwards with respect to the conveying direction 17 toward the upstream side of the paths 23, 27.

In S8, when the control unit 100 determines that the feed roller 25 has been driven to rotate for the predetermined amount, by which the recording sheet 50 could be carried beyond the conveyer roller pair 59 (S8: NO), the control unit 100 returns to S7. When the feed roller 25 has been driven to rotate for the predetermined amount (S8: YES), in S9, the control unit 100 controls the drive circuits 80, 81 to inactivate the motors 84, 85 so that the feeding operation and the reverse rotating operation activated in S3 are ceased.

In this regard, the conveyer roller 60 and the discharge roller 62 have been rotated in the second directions 113, 114 until the rotation is ceased in S9. Therefore, the recording sheet 50 picked up from the feed tray 20 and carried in the path 23 is pushed backwards with respect to the conveying direction 17 toward the upstream side of the path 23 by the conveyer roller pair 59 in the reverse registering operation during the predetermined amount of rotation, in which the recording sheet 50 could be carried beyond the conveyer roller pair 59 toward the downstream side of the conveying direction 17. Due to the backward pressure by the conveyer roller pair 59 in the reverse registering operation, the orientation of the recording sheet 50 can be corrected with respect to the conveying direction 17 even when the recording sheet 50 is gloss paper with firmness.

Following S9, in S10, the control unit 100 controls the drive circuit 81 to activate the motor 85 and rotate the conveyer roller 60 and the discharge roller 62 in the first and normal directions 111, 112 respectively. Thus, the recording sheet 50 is nipped with the conveyer roller pair 59 and the discharge roller pair 64 and carried in the paths 23, 27 in the conveying direction 17. When the recording sheet 50 passes above the platen and below the image forming unit 24, an image is formed on the upper surface thereof, and the recording sheet 50 is discharged on the discharge tray 21.

In S11, the control unit 100 examines to judge as to whether printable data for a next page is present and stored in the RAM 103. When the printable data for the next page is present (S11: YES), the control unit 100 returns to S2. When no printable data for a new page is present (S11: NO), the control unit 100 terminates the flow.

In the present embodiment, when the control unit 100 judges that the feeding error has occurred (S5: YES), the feeding operation is paused and resumed. That is, rotation of the feed roller 25 is stopped and resumed so that the feed roller 25 retries to pick up the topmost recording sheet 50 in the feed tray 20 and the slipping on the topmost recording sheet 50 is resolved. Thus, the topmost recording sheet 50 can be fed into the path 23.

In the present embodiment, however, according to the reverse rotating operation of the conveyer roller 60 and the discharge roller 62, which is conducted at the same time when the feed roller 25 rotates in the feeding operation, the recording sheet 50, which has been withdrawn from the discharge tray 21 and carried in the reverse direction, may remain in the path 27 due to a feeding error occurred during the feeding operation by the feed roller 25. In this occasion, when the feeding operation by the feed roller 25 is resumed to stop idle rotation of the feed roller 25 on the recording sheet 50, the recording sheet 50 once withdrawn and remaining in the path 27 is further carried in the reverse direction for a second time. Therefore, the recording sheet 50 is reversely carried twice for a period longer than the set time T. Accordingly, in the second feeding operation, the reversely carried recording sheet 50 may reach the conveyer roller pair 59 before the recording sheet 50 fed by the feed roller 25 reaches the conveyer roller pair 59. Thus, the reversely carried recording sheet 50 may interfere the feeding operation and the reverse registering operation of the recording sheet 50 fed by the feed roller 25.

In consideration of the above, in the present embodiment, when the control unit 100 determines that the elapsed time t is greater than or equal to the set time T (i.e., a feeding error has occurred) (S5: YES), in S12, the control unit 100 controls the drive circuits 80, 81 to inactivate the motors 84, 85 so that the feeding operation and the reverse rotating operation activated in S3 are ceased. Thereafter, in S13, the control unit 100 controls the drive circuit 81 to activate the motor 85 and rotate the conveyer roller 60 and the discharge roller 62 in the first and normal directions 111, 112 respectively. In the above steps S5, S12, and S13, the control unit 100 rotates the conveyer roller 60 and the discharge roller 62 in the first and normal direction 111, 112 simultaneously upon occurrence of a feeding error. Therefore, even when the withdrawn recording sheet 50 is present in the path 27, the withdrawn recording sheet 50 is carried in the conveying direction 17 to be discharged on the discharge tray 21. Following the discharging operation in S13, the control unit 100 returns to S2, in which a feeding operation is resumed.

When the once withdrawn recording sheet 50 is carried in the discharging operation in S13, no image forming operation is conducted to the withdrawn recording sheet 50 when the withdrawn recording sheet 50 passes above the platen 42, since the withdrawn recording sheet 50 has been already through the image forming operation. Further, the control unit 100 executes S12 and S13 following the affirmative judgment in S7 (S7: YES). This is because of that a recording sheet 50 once discharged on the discharge tray 21 may be withdrawn in the path 27 and carried to reach the conveyer roller pair 59 even without a feeding error.

According to the above embodiment, the conveyer roller 60 and the discharge roller 62 having been rotated in the second directions 113, 114 are rotated in the first directions 111, 112 upon judgment of the control unit 100 that the feeding error has occurred. Therefore, the reversely carried recording sheet 50 remaining in the path 27 is discharged by the discharge roller pair 64 onto the discharge tray 21. Thus, the feeding operation resumed after a feeding error and the reverse registering operation can be prevented from being interfered by the reversely carried recording sheet 50 remaining in the path 27.

Further, according to the above embodiment, the conveyer roller 60 and the discharge roller 62 are rotated in the first directions 111, 112 when the elapsed time t is greater than or equal to the set time T. Therefore, when the set time T is set to have an effective length, the feeding operation resumed after a feeding error and the reverse registering operation can be prevented from being interfered by the reversely carried recording sheet 50 remaining in the path 27 even without having the reversely carried recording sheet 50 detected by a sensor and the like.

In the above embodiment, the conveyer roller 60 and the discharge roller 62 having been rotated in the reverse direction are switched to rotate in the normal direction based on occurrence of a feeding error. In another embodiment, for example, the rotating direction of the conveyer roller 60 and the discharge roller 62 may be switched to the normal direction based on occurrence of a feeding error and detection of the reversely carried recording sheet 50 by an optical sensor 75 (see FIG. 6). The modified embodiment with the optical sensor 75 will be described hereinbelow.

Figure 6:
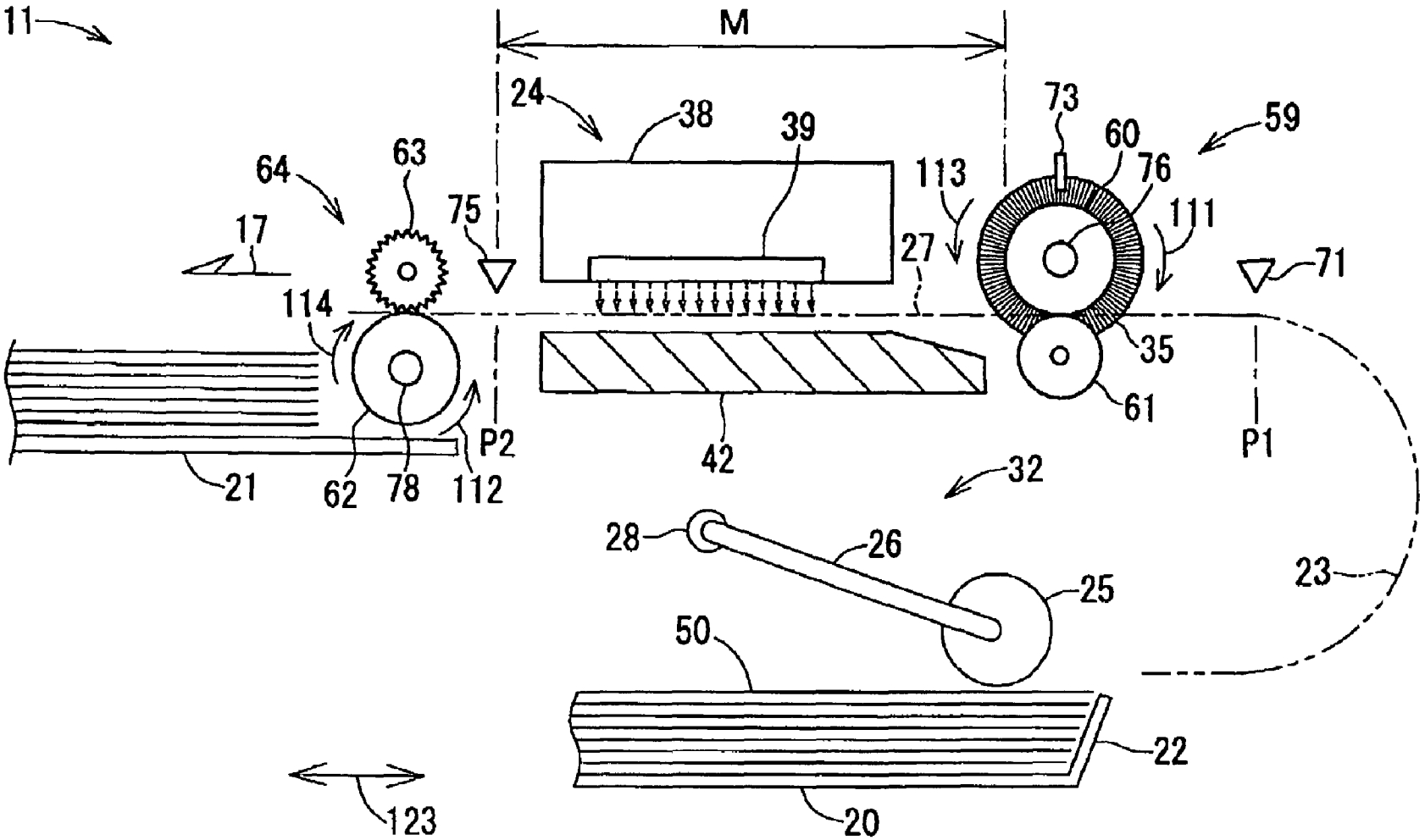
FIG. 6 illustrates an internal configuration of the printer unit 11 according to a modified embodiment of the present invention.

FIG. 6 illustrates an internal configuration of the printer unit 11 according to the modified embodiment of the present invention. In the present embodiment, the printer unit 11 includes the optical sensor 75 in the path 27. The optical sensor 75 is to detect presence of the reversely carried recording sheet 50 in a position P2, which is in between the conveyer roller pair 59 and the discharge roller 64 in the path 27. In order to detect the recording sheet 50 withdrawn from the discharge tray 21, the optical sensor 75 is arranged in the position P2, which is on the upstream side with respect to the discharge roller pair 64 in the path 27 and in the vicinity of the discharge roller pair 64. The optical sensor 75 is a reflective photo-sensor including a light-emitting diode (not shown) and a light receiver (not shown). The light-emitting diode emits light downward, and the light is reflected on the surface of the recording sheet 50 when the withdrawn recording sheet 50 is present in the path 27 at the position P2. Meanwhile, the emitted light is reflected on a part of a frame (not shown) of the printer unit 11, which is located directly below the light-emitting diode when no recording sheet 50 is in the position P2. The reflected light is received by the light receiver of the optical sensor 75. When the reflected light is received by the light receiver, a sensor signal depending on a level of brightness being received is generated. The part of the frame on which the emitted light reflects is colored in a color darker with lower reflectance than the surface of the recording sheet 50; therefore, when no recording sheet 50 is present in the position P2 and the emitted light is reflected on the part of the frame, the light reflected in the lower reflectance is received by the light receiver. Thus, a sensor signal according to the lower reflectance is generated in the optical sensor 75. Meanwhile, when the recording sheet 50 is present in the position P2 and the emitted light is reflected on the surface of the recording sheet 50, the light reflected with the higher reflectance is received by the light receiver, and the a sensor signal according to the higher reflectance is generated in the optical sensor 75.

The optical sensor 75 is connected to the ASIC 109, although the connection is not shown. The sensor signal generated in the optical sensor 75 is output to the control unit 100, which detects presence of the recording sheet 50 in the position P2 based on the levels of the sensor signals output from the optical sensor 75.

Figure 7:
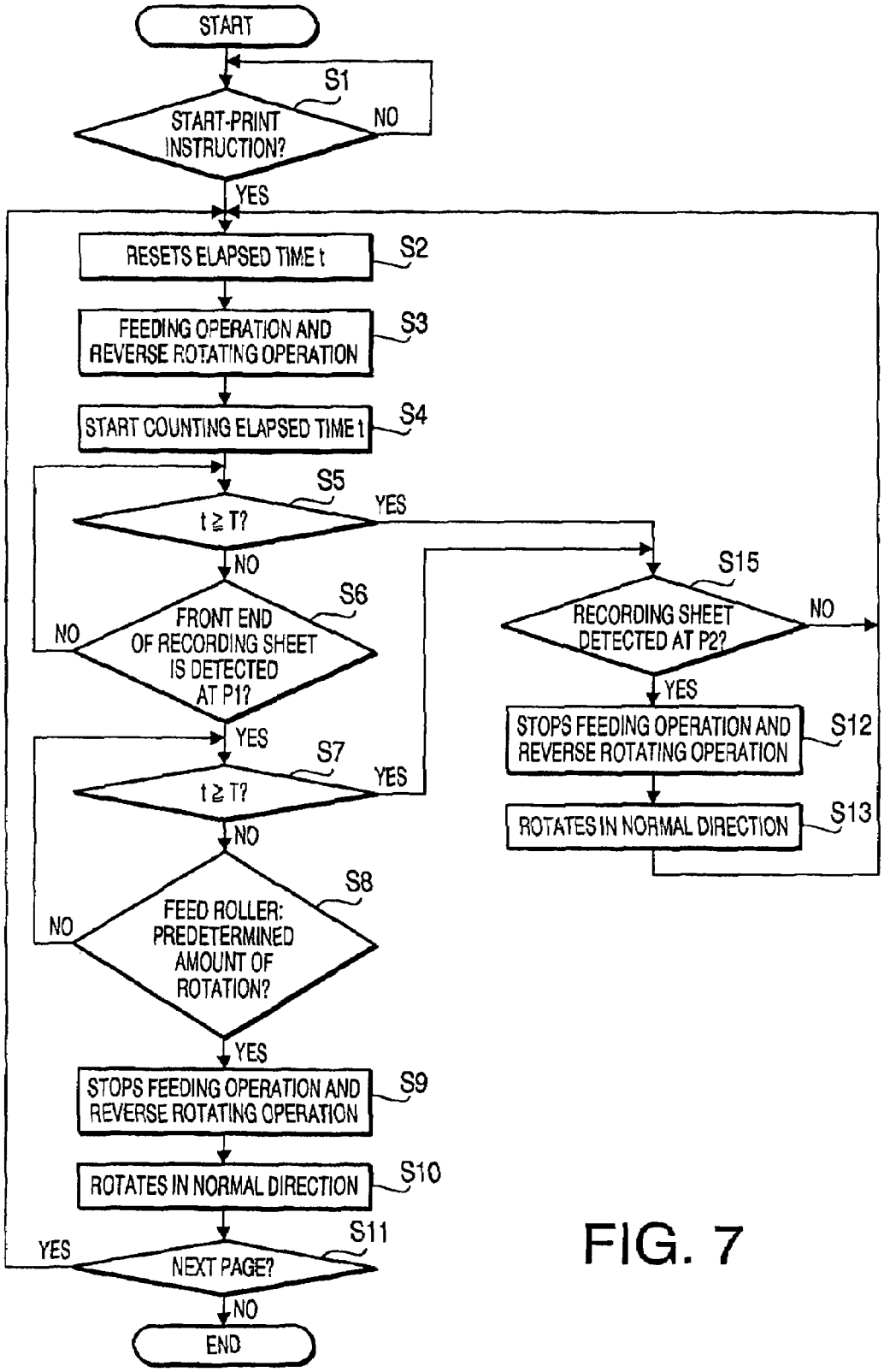
FIG. 7 is a flowchart to illustrate a feeding operation to feed a recording sheet in the printer unit 11 in the MFD 10 according to the modified embodiment of the present invention.

Next, a feeding operation in cooperation with the optical sensor 75 will be described with reference to FIG. 7. FIG. 7 is a flowchart to illustrate the feeding operation to feed and convey the recording sheet 50 in the printer unit 11 in the MFD 10 according to the modified embodiment of the present invention. The flow according to the modified embodiment shown in FIG. 7 is identical with the flow according to the previous embodiment shown in FIG. 5 except S15, which is conducted prior to S12. Therefore, description of steps in the modified embodiment identical with the steps in the previous embodiment is herein omitted.

When several dozen of recording sheets 50 are piled up on the discharge tray 21, the height difference between the level of the topmost recording sheet 50 on the discharge tray 21 and the nipped position of the discharge roller pair 64 becomes small. Therefore, the topmost recording sheet 50 in the discharged sheet stack can be withdrawn from the discharge tray 21 and carried backwards in the path 27 when the feeding operation and the reverse rotating operation start. On the contrary, when a small amount of recording sheets 50 is piled up on the discharge tray 21, the recording sheet 50 on the discharge tray 21 tends not to be withdrawn in the path 27. Thus, the reverse conveyance of the once discharged recording sheet 50 may not necessarily occur upon the feeding operation and the reverse rotating operation. Therefore, the normal rotation of the conveyer roller 60 and the discharge roller 62 in the normal direction in S13 can be performed limitedly when the reverse conveyance of the recording sheet 50 is detected in the path 27.

During the feeding operation, the conveyer roller 60 and the discharge roller are rotated in the second directions 113, 114 (see S3). Therefore, the recording sheet 50 fed by the feed roller 25 is pushed backwards in the reverse direction by the conveyer roller pair 59 and prevented from reaching the point P2. Thus, the recording sheet 50 fed by the feed roller 25 cannot be detected by the optical sensor 75. Instead, when the optical sensor 75 detects presence of a recording sheet 50 in the path 27 at the position P2, it is determined that the detected recording sheet 50 is a reversely-carried recording sheet 50 withdrawn from the discharge tray 21.

As shown in FIG. 6, when the control unit 100 determines that the elapsed time t is greater than or equal to the set time T in S5 (S5: YES) and in S7 (S7: YES), in S15, the control unit 100 judges as to whether the recording sheet 50 is detected at the position P2 based on the level of the sensor signal, which is output from the optical sensor 75. When the recording sheet 50 is not detected at the position P2 (S15: NO), it is determined that no recording sheet 50 has been withdrawn in the path 27. Therefore, the control unit 100 skips S12 and S13 and returns to S2.

In S15, when the recording sheet 50 is detected at the position P2 (S15: YES), it is determined that the recording sheet 50 has been withdrawn from the discharge tray 21 and remaining in the path 27. Thus, upon occurrence of a feeding error (S5: YES) and detection of the recording sheet 50 by the optical sensor 75 (S15: YES), the conveyer roller 60 and the discharge roller 62 are rotated in the first directions 111, 12 (S13). In this configuration, an unnecessary discharging operation, in which the conveyer roller 60 and the discharge roller 62 are rotated in the first directions 111, 112 in vain when no recording sheet 50 is in the path 27, can be omitted. Further, a period between occurrence of the feeding error and retry of the feeding operation can be effectively shortened.

According to the modified embodiment, the optical sensor 75 is arranged on the upstream side with respect to the discharge roller pair 64 in the path 27; therefore, the reversely carried recording sheet 50 may be off the position P2 but nipped between the discharge roller pair 64 and present in the path 27 without being detected by the optical sensor 75. When the withdrawn recording sheet 50 is in such a position, and when the set time T is substantially close to the period B, the withdrawn recording sheet 50 nipped with the discharge roller pair 64 is reversely conveyed and may reach the conveyer roller pair 59 before the elapsed time t becomes greater than or equal to the set time T. In order to avoid the situation, in the modified embodiment, the period B is set to have a length, in which the withdrawn recording sheet 50 can be conveyed by the reversely rotated discharge roller pair 64 in the reverse direction no further beyond distance M (see FIG. 6), whilst the distance M is a length between the optical sensor 75 and a contact position for the withdrawn recording sheet 50 with the conveyer roller pair 59. The period B can be determined based on, for example, the distance M and a rotation speed of the conveyer roller 60 (and the discharge roller 62), which can be obtained based on the result detected by the rotary encoder 83.

Although examples of carrying out the invention has been described, those skilled in the art will appreciate that there are numerous variations and permutations of a sheet conveyer device and an image reading apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, in the above embodiments, the conveyer roller 60 is arranged on the opposite side from the discharge roller 62 with respect to the path 27, and vice versa. Accordingly, the first direction 111 of the conveyer roller 60 is opposite from the first direction 112 of the discharge roller 62. Further, the second direction 113 of the conveyer roller 60 is opposite from the second direction 114 of the discharge roller 114. It is to be noted that, when the conveyer roller 60 and the discharge roller 62 are arranged on a same side with respect to the path 27, the first direction of the conveyer roller 60 and the first direction of the discharge roller 62 coincide with each other. Similarly, the second direction of the conveyer roller 60 and the second direction of the discharge roller 62 coincide with each other.

Further, in the above embodiments, the feed roller 25 is driven by the motor 84 whilst the conveyer roller 60 and the discharge roller 62 are driven by the motor 85. However, the feed roller 25, the conveyer roller 60, and the discharge roller 62 may be driven by a same motor. In such a case, a drive circuit may be configured such that the feeding operation of the feed roller 25 and the reverse rotation of the conveyer roller 60 and the discharge roller 62 are generated by, for example, normal rotation of the motor, whilst normal rotation of the conveyer roller 60 and the discharge roller 62 are generated by reverse rotation of the motor.

Furthermore, the register sensor 71 to detect presence of the recording sheet 50 fed by the feeding roller 25 may be replaced with a different type of sensor.

The sheet conveyer device in the above embodiments is installed in the printer unit 11. However, the sheet conveyer device may replace the ADF 28 in the scanner unit 12. In this configuration, orientation of the original document sheets to be fed in the scanner unit 12 may be corrected with respect to a scanning path so that scanned and discharged documents are prevented from being withdrawn in the scanning path. Thus, a succeeding document to be scanned can be prevented from being interfered by the withdrawn document in the scanning operation.

What is claimed is:

1. A sheet conveyer device to convey a sheet in a conveyer path, comprising:

a first roller pair, which is arranged in an intermediate position in the conveyer path and conveys the sheet in the conveyer path;

a feeder to feed the sheet in the conveyer path toward the first roller pair during a feeding operation;

a discharge portion, on which the sheet carried through the conveyer path is discharged;

a second roller pair, which is arranged in the conveyer path in a position closer to the discharge portion than the first roller pair and conveys the sheet in the conveyer path;

a control unit to control the first roller pair and the second roller pair to rotate synchronously in one of a first direction, being a direction to convey the sheet toward the discharge portion, and a second direction, being a direction opposite from the first direction; and a judging system to judge as to whether a sheet feeding error has occurred in the feeder, wherein the control unit controls the first roller pair and the second roller pair to rotate synchronously in the second direction during the feeding operation and to rotate synchronously in the first direction when the judging system judges that the sheet feeding error has occurred during the feeding operation.

2. The sheet conveyer device according to claim 1, further comprising:

a first detector to detect presence of the sheet in a first position, which is on a side opposite from the second roller pair with respect to the first roller pair in the conveyer path; and a timer to count an elapsed time period, which is a time period since the feeding operation started, wherein the judging system judges that the feeding error has occurred when the first detector fails to detect presence of the sheet in the first position before the elapsed time is counted to be greater than or equal to a predetermined set time.

3. The sheet conveyer device according to claim 2, wherein the predetermined set time is longer than a first period, which starts upon beginning of the feeding operation and ends when the sheet is assumed to be detected by the first detector without being interrupted by the sheet feeding error, and shorter than a second period, which starts upon rotation of the first roller pair and the second roller pair in the second direction to convey the sheet once discharged on the discharge portion and ends when the sheet is assumed to reach the first roller pair.

4. The sheet conveyer device according to claim 1, further comprising:

a second detector to detect presence of the sheet in a second position, which is an intermediate position between the first roller pair and the second roller pair, wherein the control unit controls the first roller pair and the second roller pair to rotate synchronously in the first direction when the judging system judges that the sheet feeding error has occurred during the feeding operation and the second detector detects presence of the sheet in the second position.

5. The sheet conveyer device according to claim 1, further comprising:

a sheet container, in which a plurality of sheets are stacked, wherein the feeder includes a roller, which is pressed onto a topmost sheet in the stacked sheets and rotates thereon to feed the topmost sheet into the conveyer path.

6. An image forming apparatus, comprising:

a sheet conveyer device to convey a sheet in a conveyer path; and an image forming unit to form an image on the sheet conveyed in the conveyer path, wherein the sheet conveyer device includes:

a first roller pair, which is arranged in an intermediate position in the conveyer path and conveys the sheet in the conveyer path;

a feeder to feed the sheet in the conveyer path toward the first roller pair during a feeding operation;

a discharge portion, on which the sheet carried through the conveyer path is discharged;

a second roller pair, which is arranged in the conveyer path in a position closer to the discharge portion than the first roller pair and conveys the sheet in the conveyer path;

a control unit to control the first roller pair and the second roller pair to rotate synchronously in one of a first direction, being a direction to convey the sheet toward the discharge portion, and a second direction, being a direction opposite from the first direction; and a judging system to judge as to whether a sheet feeding error has occurred in the feeder, wherein the control unit controls the first roller pair and the second roller pair to rotate synchronously in the second direction during the feeding operation and to rotate synchronously in the first direction when the judging system judges that the sheet feeding error has occurred during the feeding operation; and wherein the image forming unit is arranged along the conveyer path between the first roller pair and the second roller pair.

* * * * *